US012680478B2

(12) United States Patent
Hollingworth et al.

(10) Patent No.: US 12,680,478 B2
(45) Date of Patent: Jul. 14, 2026

(54) METHOD OF OPERATING A HEAT CYCLE SYSTEM, HEAT CYCLE SYSTEM AND METHOD OF MODIFYING A HEAT CYCLE SYSTEM

(71) Applicant: Noditech AB, Norrköping (SE)

(72) Inventors: Hardy Hollingworth, Vikbolandet (SE); Karl Gustav Persson, Huskvarna (SE)

(73) Assignee: NODITECH AB, Norrköping (SE)

( * ) Notice: Subject to any disclaimer, the term of this patent is extended or adjusted under 35 U.S.C. 154(b) by 0 days.

(21) Appl. No.: 18/875,438

(22) PCT Filed: Jun. 21, 2023

(86) PCT No.: PCT/EP2023/066818

§ 371 (c)(1),
(2) Date: Dec. 16, 2024

(87) PCT Pub. No.: WO2023/247633

PCT Pub. Date: Dec. 28, 2023

(65) Prior Publication Data

US 2025/0382901 A1 Dec. 18, 2025

(30) Foreign Application Priority Data

Jun. 21, 2022 (EP) ..... 22180199

(51) Int. Cl.
*F01K 13/00* (2006.01)
*F01K 11/00* (2006.01)
(Continued)

(52) U.S. Cl.
CPC ..... *F01K 13/006* (2013.01); *F01K 11/00* (2013.01); *F01K 21/005* (2013.01); *F25B 11/02* (2013.01); *F25B 30/02* (2013.01)

(58) Field of Classification Search
CPC ..... F01K 13/00; F01K 13/006; F01K 11/00; F01K 11/02; F01K 21/00; F01K 21/005;
(Continued)

(56) References Cited

U.S. PATENT DOCUMENTS 6,913,076 B1 * 7/2005 Hays ..... F25B 30/02 165/274
7,523,621 B2 4/2009 Johansson
(Continued)

FOREIGN PATENT DOCUMENTS

CH 714328 A2 5/2019
DE 102009020062 A1 * 12/2009 ..... F25B 40/00
(Continued)

OTHER PUBLICATIONS

International Search Report and Written Opinion of the International Searching Authority mailed Oct. 27, 2023 for PCT International Application No. PCT/EP2023/066818.
(Continued)

*Primary Examiner* — Loren C Edwards
(74) *Attorney, Agent, or Firm* — Volpe Koenig

(57) ABSTRACT

A method of operating a heat cycle system, wherein the heat cycle system comprises a working fluid, which is cycled through a circuit comprising a compressor, a condenser, an expander unit, and an evaporator and wherein the expander unit is configured to generate a rotating mechanical motion, comprises operating the evaporator at an evaporator working fluid evaporation capacity that is at least about 110% of the nominal evaporator working fluid evaporation capacity. There is also disclosed a heat cycle system as well as a method of modifying a heat cycle system.

14 Claims, 4 Drawing Sheets

(51) Int. Cl.
*F01K 21/00* (2006.01)
*F25B 11/02* (2006.01)
*F25B 30/02* (2006.01)

(58) Field of Classification Search
CPC ..... F01K 25/00; F01K 25/08; F25B 11/02; F25B 30/02; F25B 2400/14
See application file for complete search history.

(56) References Cited

U.S. PATENT DOCUMENTS

| | | | | |
|---|---|---|---|---|
| 7,637,108 | B1 * | 12/2009 | Langson | F01K 25/10 60/624 |
| 2006/0162377 | A1 * | 7/2006 | Collings | F25B 41/39 62/527 |
| 2009/0165456 | A1 | 7/2009 | Masada | |
| 2011/0083437 | A1 * | 4/2011 | Ast | F01K 25/08 60/671 |
| 2022/0049651 | A1 | 2/2022 | Bollinger et al. | |

FOREIGN PATENT DOCUMENTS

| | | | |
|---|---|---|---|
| DE | 102008041939 | A1 | 3/2010 |
| DE | 102009042306 | A1 | 4/2011 |
| DE | 102020110560 | A1 | 10/2021 |
| EP | 0703420 | A2 | 3/1996 |
| JP | 2005172336 | A | 6/2005 |
| JP | 2007132541 | A | 5/2007 |
| JP | 2009216275 | A | 9/2009 |
| KR | 20100042969 | A | 4/2010 |
| WO | 2005024189 | A1 | 3/2005 |
| WO | 2006066347 | A1 | 6/2006 |
| WO | 2011059131 | A1 | 5/2011 |
| WO | 2017200916 | A1 | 11/2017 |
| WO | 2020225583 | A1 | 11/2020 |
| WO | 2022199862 | A1 | 9/2022 |

OTHER PUBLICATIONS

Extended Euroean Search Report, European Patent Application No. 22180199.6, dated Jan. 10, 2023.

ISA State Intellectual Property Office of the People's Republic of China, Written Opinion of the International Searching Authority Issued on Oct. 27, 2023 for Chinese Patent Application No. PCT/EP2023/066818.

* cited by examiner

METHOD OF OPERATING A HEAT CYCLE SYSTEM, HEAT CYCLE SYSTEM AND METHOD OF MODIFYING A HEAT CYCLE SYSTEM

TECHNICAL FIELD

The present disclosure relates to a heat cycle system, for application in a heat pump or in a cooling system, and to a method of operating a heat cycle system.

BACKGROUND

Heat cycle systems operating according to cyclic heat processes, such as a Carnot process, are used in many applications.

In some applications, the objective is to provide heat, such as in heat pump systems that are used to heat a space by picking up heat from ground, bedrock, water or air and supplying the heat to a heating system for the space.

In other applications, the objective is to remove heat, i.e. to cool something, such as in air conditioning systems or in cooling/refrigeration systems, the objective is to remove heat from a space or from an object.

In the Carnot process, energy is input in the form of heat Q picked up by the evaporator and in the form of mechanical energy W supplied by the compressor. The mechanical energy may be provided by a conversion of electric energy by an electric motor. Furthermore, energy is output in the form of heat $Q_H$ provided by the condenser. A heating coefficient of performance ($COP_H$) is defined as $Q_H/W$ and a cooling coefficient of performance ($COP_C$) is defined as $O_C/W$.

FIG. 1 schematically illustrates a conventional heat cycle system, in which is circulated a working fluid.

The system comprises a compressor 10 having a compressor input where the working fluid is in a first state with a first pressure P1, a first temperature T1 and a first enthalpy H1, and a compressor output where the working fluid is in a second state with a second pressure P2, a second temperature T2 and a second enthalpy H2.

The compressor 10 is configured to increase the pressure of the working fluid, such that P2>P1.

The compressor may be electrically powered.

The system further comprises a condenser 11 having a condenser input which is connected to the compressor output to receive the working fluid in the second state, and a condenser output, where the working fluid is in a third state P3, T3, H3.

The condenser 11 may be configured to exchange heat with a heat delivery circuit 12, wherein heat is delivered from the condenser 11, whereby the temperature of the working fluid may be reduced, such that T3<T2 and the enthalpy of the working fluid is reduced, such that H3<H2. At least part of the working fluid turns from vapour state to liquid state.

As an alternative, the condenser 11 may be configured to deliver heat to an airflow, or to merely dissipate heat to surrounding air, as could be the case in a refrigeration system.

The heat delivery circuit 12 may be e.g. a heating circuit for providing heating to a space, such as one or more dwellings or an automobile interior. In other applications, heat may be used in a drying process, or the like.

The system further comprises an expansion valve 13, which is connected to the condenser output.

The expansion valve 13 is configured for isenthalpic expansion, to allow the working fluid to expand to a fourth state P4, T4, H4, such that the working fluid, at an expansion valve output has a lower pressure than the third state, such that P4<P3.

The system further comprises an evaporator 14, which may be configured to exchange heat with a heat supplying circuit 15, such that the working fluid undergoes evaporation, wherein heat is received by the evaporator 14, whereby the enthalpy of the working fluid will increase, such that H1>H4. Also the temperature may be increased, such that T1>T4.

The heat supplying circuit 15 may be a cooling circuit in a cooling device or an air conditioning device. Alternatively, the heat supplying circuit 15 may be configured to pick up heat from e.g. air, ground, bedrock or water in a heat pump system.

An evaporator input is connected to receive the working fluid in the fourth state from the expansion valve 13. An evaporator output is connected to the input of the compressor 10.

There is a general desire to increase performance of heat cycle systems, and thus to improve the coefficient of performance.

It is known from e.g. WO2013141805A1 to include in a heat cycle system an energy converter for converting the energy of a pressurized fluid into mechanical energy, which may then be used for generating electric energy.

In Dimitriou, P.: *Experimental evaluation of work recovery potential in commercial heat pumps using a piston expander prototype,* National Technical University of Athens, 2017, there is disclosed a heat cycle where an expansion valve is replaced by a piston expander, which is mechanically coupled to the compressor, so as to provide drive power to the compressor.

There is still a general need for improving heat cycle systems, in particular in terms of efficiency and/or production of electric energy.

SUMMARY

It is an objective of the present disclosure to provide a heat cycle system capable of producing electric energy and preferably also having improved efficiency.

A particular objective includes the provision of a heat cycle system that is suitable for use as a cooling system, for cooling a space or a body of material.

The invention is defined by the appended independent claims, with embodiments being set forth in the dependent claims, in the following description and in the drawings.

According to a first aspect, there is provided a method of operating a heat cycle system, wherein the heat cycle system comprises a working fluid, which is cycled through a circuit comprising a compressor, a condenser, an expander unit, and an evaporator, wherein the expander unit is configured to generate a rotating mechanical motion. The method comprises operating the compressor to receive the working fluid in a first state, with a first pressure, a first temperature and a first enthalpy, and to compress the working fluid to a second state with a second pressure, a second temperature and a second enthalpy, operating the condenser to receive the working fluid in the second state, and to condense the working fluid to a third state with a third pressure, a third temperature and a third enthalpy, operating the expander unit to receive the working fluid in the third state, and to expand the working fluid to a modified fourth state with a modified fourth pressure, a modified fourth temperature and a modified fourth enthalpy, operating the evaporator to receive the working fluid in the modified fourth state, and to evaporate the working fluid to the first state, wherein a nominal evaporator working fluid evaporation capacity is defined as an amount of an enthalpy reduction provided by the condenser less an amount of an enthalpy increase provided by the compressor. The method further comprises operating the evaporator at an evaporator working fluid evaporation capacity that is at least about 110% of the nominal evaporator working fluid evaporation capacity.

The compression part of the process may be essentially isentropic, i.e. isentropic except for losses.

The condensation part of the process may be essentially isobaric and/or isotherm, i.e. essentially isobaric/isothermal, except for losses.

The expansion part of the process may be essentially isentropic, i.e. isentropic except for losses. In particular, the expansion part of the process is not isenthalpic, as would be the case with an expansion valve.

The evaporation part of the process may be essentially isobaric and/or isothermal, i.e. essentially isobaric/isothermal, except for losses.

In particular, the working fluid evaporation capacity of the evaporator may be about 110-120%, about 120-130%, about 130-140%, about 140-150%, about 150-160%, about 160-170%, about 170-180%, about 180-190% or about 190-200%, of the nominal evaporator working fluid evaporation capacity.

The inventors have surprisingly found that by operating the system as described above, it is possible to at least produce electric power without any loss in the system's coefficient of performance.

The rotary motion provided by the expander unit may be used to at least partially power the compressor, and/or another mechanically operated device, in particular a generator for generating electric power.

It has also been noted that operation as per the above may in addition increase the coefficient of performance, COP.

Hence, operation as per above provides a system that has a COP which is at least as high as a corresponding system without the expander unit and which still generates a useful amount of electric energy.

In the method, energy provided to the working fluid by the evaporator exceeds the energy required to essentially isobaric raise an enthalpy of the working fluid from an enthalpy level at a condenser outlet to an enthalpy level corresponding to moist or superheated vapor.

An evaporator power (energy) transferred to the working fluid may correspond to a sum of a heat power (thermal energy) removed from the working fluid by the condenser and a power (mechanical energy) generated by the working fluid at the rotatable expander less a power provided to the working fluid by the compressor.

The expander unit may be operated with the working fluid partially or entirely in saturated state.

A working fluid pressure drop over the evaporator may be less than about 5 bar, preferably about 0.50-0.75 bar; about 0.75-1.00 bar; about 1.00-1.25 bar; about 1.25-1.50 bar; about 1.50-1.75 bar; about 1.75-2.00 bar; about 2.00-2.25 bar; about 2.25-2.50 bar; about 2.50-2.75 bar; about 2.75-3.00 bar; about 3.00-3.25 bar; about 3.25-3.50 bar; about 3.50-3.75 bar; about 3.75-4.00 bar; about 4.00-4.25 bar; about 4.25-4.50 bar; about 4.50-4.75 bar; or about 4.75-5.00 bar.

This represents a significant reduction in pressure drop as compared to current commercially available systems, which typically operate with a 6-8 bar pressure drop over the evaporator.

The expander unit may be selected from a group consisting of a rotation type expander, a swing type expander, a scroll type expander, a GE rotor type expander, a reciprocating type expander, a screw type expander and a radial turbo type expander.

Such expanders can be provided by reversing a corresponding compressor, typically coupled with the removal of any non-return valve originally provided in the compressor.

The method may further comprise operating the expander unit to at least partially energy at least one device.

In the method, a generator may be mechanically connected to the expander unit for generating electricity, and the generator may be operated to generate electric energy as the rotatable expander is caused to rotate during the expansion of the working fluid.

The method may further comprise subcooling the working fluid downstream of the condenser and upstream of the expander unit.

Hence, heat may effectively be transferred from the working fluid immediately downstream of the condenser to the working fluid immediately upstream of the compressor.

The working fluid downstream of the condenser and upstream of the expander unit may be caused to exchange heat with the working fluid upstream of the compressor and downstream of the evaporator.

The method may further comprise causing at least some of the working fluid downstream of the expander unit and upstream of the evaporator to undergo further expansion in an expansion valve.

The working fluid exiting from the expander unit may be selectively distributed between the expansion valve and a bypass connection, which bypasses the expansion valve.

The expansion valve may be operable based on a condition downstream of the evaporator, preferably immediately downstream of the evaporator.

The evaporator may be caused to exchange heat with an evaporator circuit comprising a second working fluid, so as to provide e.g. a heat pump.

The second working fluid may be a liquid, such as a brine.

Alternatively, the second working fluid may be a gas, such as air.

The condenser may be caused to exchange heat with a condenser circuit comprising a third working fluid.

The third working fluid may be a liquid.

The third working fluid may be a gas, such as air.

The evaporator may be oversized with regard to an identical system comprising the compressor, the condenser and an expansion valve configured for isenthalpic expansion of the working fluid, instead of the expander unit.

The condenser may be caused to exchange heat with a first external working fluid in the form of a gas.

The evaporator may be caused to exchange heat with a second external working fluid in the form of a gas.

Hence, the method may provide an air-to-air cooling system. The heat cycle system may be operated as a non-reversible cooling system for cooling a space or a body of material. Hence, the heat cycle system is configured to only cool the space or body of material, while not being reversible to, instead, heat the space or body of material.]

According to a second aspect, there is provided a heat cycle system, comprising a working fluid, which is cycled through a circuit comprising a compressor, a condenser, an expander unit, and an evaporator, wherein the expander unit is configured to generate a rotating mechanical motion. In the heat cycle system, a nominal evaporator working fluid evaporation capacity is defined as an amount of an enthalpy reduction provided by the condenser less an amount of an enthalpy increase provided by the compressor. The evaporator is sized and adapted to provide an evaporator working fluid evaporation capacity that is at least 110% of the nominal evaporator working fluid evaporation capacity.

In particular, the working fluid evaporation capacity of the evaporator may be about 110-120%, about 120-130%, about 130-140%, about 140-150%, about 150-160%, about 160-170%, about 170-180%, about 180-190% or about 190-200%, of the nominal evaporator working fluid evaporation capacity.

The evaporator may be oversized with regard to an identical system comprising the compressor, the condenser and an expansion valve configured for expansion of the working fluid, instead of the expander unit.

The evaporator may be configured to evaporate the working fluid received from the expander unit to at least saturation, such that the working fluid is in a saturated vapor phase at an evaporator output.

The expander unit may comprise a rotatable expander, in which the working fluid flowing through the expander causes the rotatable expander to rotate, wherein a generator may be mechanically connected to the rotatable expander to generate electricity as the rotatable expander is caused to rotate, The expander unit may be selected from a group consisting of a rotation type expander, a swing type expander, a scroll type expander, a GE rotor type expander, a reciprocating type expander, a screw type expander and a radial turbo type expander.

Such expanders can be provided by reversing a corresponding compressor, typically coupled with the removal of any non-return valve originally provided in the compressor.

A working fluid pressure drop over the evaporator may be less than about 5 bar, preferably about 0.50-0.75 bar; about 0.75-1.00 bar; about 1.00-1.25 bar; about 1.25-1.50 bar; about 1.50-1.75 bar; about 1.75-2.00 bar; about 2.00-2.25 bar; about 2.25-2.50 bar; about 2.50-2.75 bar; about 2.75-3.00 bar; about 3.00-3.25 bar; about 3.25-3.50 bar; about 3.50-3.75 bar;

about 3.75-4.00 bar; about 4.00-4.25 bar; about 4.25-4.50 bar; about 4.50-4.75 bar; or about 4.75-5.00 bar.

A channel connecting an expander outlet to an evaporator assembly inlet may be less than about 0.5 m, preferably less than about 0.2 m, less than about 0.1 m or less than about 0.05 m. In particular, the expander outlet may be integrated with the evaporator inlet, e.g. by being formed in one piece.

The channel may be straight.

The heat cycle system may further comprise a subcooler connected downstream of the condenser and upstream of the expander unit.

The heat cycle system may further comprise an expansion valve connected downstream of the expander unit and upstream of the evaporator.

The heat cycle system may further comprise at least one control valve for selectively distributing working fluid exiting from the expander unit between the expansion valve and a bypass connection, which bypasses the expansion valve.

The expansion valve is operable based on a condition downstream of the evaporator, preferably immediately downstream of the evaporator.

In other embodiments, the channel may be curved through about 70-110 degs, preferably about 80-100 degs, about 85-95 degs or about 90 degs.

Depending on the type of heat exchanger used for the evaporator, it may be advantageous to use a curved channel that will create some turbulence in the channel, that may improve distribution of the working fluid inside the evaporator.

The evaporator may be configured to exchange heat with an evaporator circuit comprising a second working fluid.

The second working fluid may be a liquid, such as a brine.

The second working fluid may be a gas, such as air.

The condenser may be configured to exchange heat with a condenser circuit comprising a third working fluid.

The third working fluid may be a liquid.

The third working fluid may be a gas, such as air.

In particular, the condenser may be configured to exchange heat with a first external working fluid in the form of a gas.

The first external fluid may comprise, consist or consist essentially of, air.

The evaporator may configured to exchange heat with a second external working fluid in the form of a gas.

Hence, the heat cycle system may be configured as an air-to-air heat cycle system.

The heat cycle system may be configured to be operated as a non-reversible cooling system for cooling a space or a body of material.

A space may be a building interior, a vehicle interior, or the like. A body of material may be an ice rink, or the like. Hence, the heat cycle system is configured to only cool the space or body of material, while not being reversible to, instead, heat the space or body of material.

According to a third aspect, there is provided a method of modifying a heat cycle system wherein the heat cycle system comprises:

a working fluid, which is cycled through a circuit comprising a compressor, a condenser, an expansion valve, and a first evaporator. The method comprises replacing the expansion valve with an expander unit that is configured to generate a rotating mechanical motion, and replacing the first evaporator with a second evaporator having greater working fluid evaporation capacity than the first evaporator.

The heat cycle system being modified may be a heating system for collecting heat from a fluid in the form of air or a liquid, such as a brine, and for heating a building or a vehicle.

Alternatively, the heat cycle system may be a cooling system for collecting heat from a space, such as a building space or an airflow or space in a vehicle, and for expelling the heat to an outside.

The heat cycle may also be a reversible system, which may be used either for cooling or heating a building or a vehicle.

The second evaporator may have a working fluid evaporation capacity which is about 110-120%, about 120-130%, about 130-140%, about 140-150%, about 150-160%, about 160-170%, about 170-180%, about 180-190% or about 190-200%, of the working fluid evaporation capacity of the first evaporator.

The second evaporator may present a lower working fluid pressure drop than the first evaporator.

The second evaporator may present a working fluid pressure drop which is less than 50% of that of the first evaporator, preferably less than 40% or less than 30%.

The expander unit may comprise a rotatable expander, in which the working fluid flowing through the expander causes the expander to rotate, wherein the method further comprises connecting a generator mechanically to the rotatable expander to generate electricity as the rotatable expander is caused to rotate.

The method may further comprise increasing a flow area of a working fluid connection between the expander unit and the evaporator.

The method may further comprise increasing a flow area of an expander inlet.

The method may further comprise shortening a working fluid connection between the expander unit and the evaporator.

For example, a shorter channel for the connection may be provided, or the expander outlet may be connected directly to the evaporator inlet.

DRAWINGS

DETAILED DESCRIPTION

Figure 1:
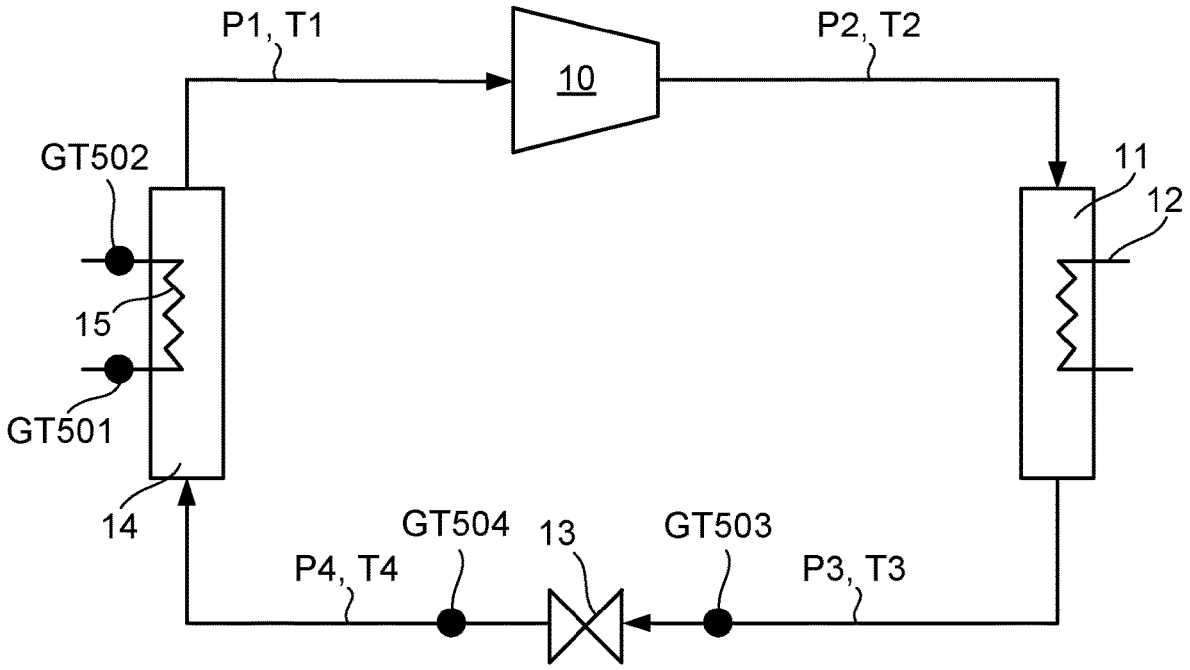
PRIOR ART Fig 1
FIG. 1 is a schematic diagram of a conventional heat cycle system.
Figure 2:
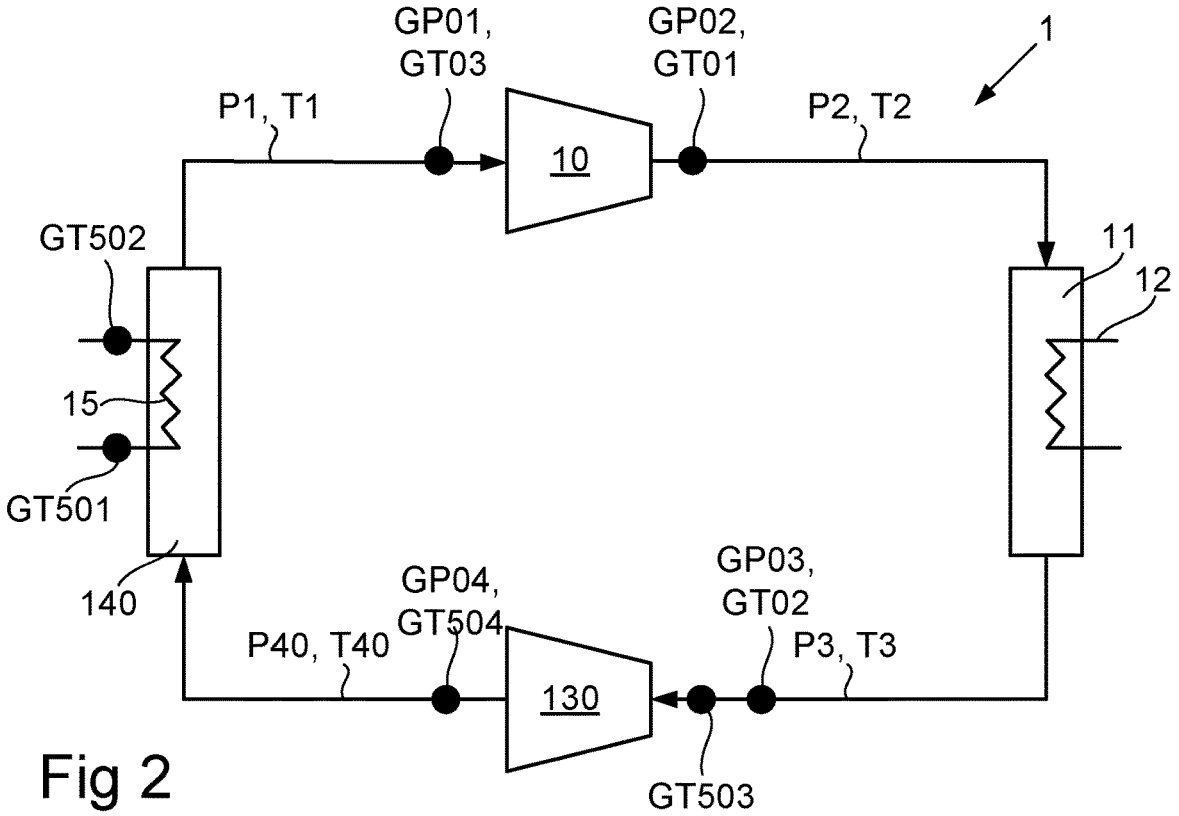
FIG. 2 is a schematic diagram of a heat cycle system according to a first embodiment.

The inventive concept will be disclosed with reference to FIG. 2, which illustrates a heat cycle system, which corresponds to the system illustrated in FIG. 1, with identical components having the same reference numerals.

The system shown in FIG. 2 differs from that shown in FIG. 1 in that the expansion valve 13 has been replaced by a rotatable expander 130 and the evaporator 14 replaced by one with larger capacity. Additionally, it may be advantageous to reduce pressure drop in the evaporator 140, and make the connection 141 between the output of the rotatable expander 130 and the evaporator 140 as short and straight as possible.

Hence, in FIG. 2 there is illustrated a heat cycle system in which is circulated a working fluid, as indicated by the arrows.

In some embodiments, the heat cycle system may be formed as a refrigeration circuit for use in an air conditioning system in a fixed construction, in a vessel or in a vehicle.

In other embodiments, the heat cycle system may be formed as a heat pump system for use in a fixed construction, such as a building, in a vessel or in a vehicle.

The system comprises a compressor 10 having a compressor input where the working fluid is in a first state with a first pressure P1, a first temperature T1 and a first enthalpy H1, and a compressor output where the working fluid is in a second state with a second pressure P2, a second temperature T2 and a second enthalpy H2.

The compressor 10 is configured to increase the pressure of the working fluid, such that P2>P1.

The compressor may be electrically powered.

The system further comprises a condenser 11 having a condenser input which is connected to the compressor output to receive the working fluid in the second state, and a condenser output, where the working fluid is in a third state P3, T3, H3.

The condenser 11 may be configured to exchange heat with a heat delivery circuit 12, wherein heat is delivered from the condenser 11, whereby the enthalpy of the working fluid may be reduced, such that H3<H2.

Alternatively, the condenser 11 may be configured to deliver heat to an airflow, or to merely dissipate heat to the surrounding environment, as could be the case in a refrigeration system.

The system further comprises a rotatable expander 130, which replaces the expansion valve 13 (FIG. 1) and which may have the form of e.g. a turbine, a scroll type expander or a GE rotor type expander. Hence, the rotatable expander 130 replaces the expansion valve 13 (FIG. 1) which would otherwise be provided at this stage in the heat cycle process.

An expander input is connected to receive the working fluid in the third P3, T3, H3 state from the condenser 11.

The rotatable expander 130 is configured to allow the working fluid to expand to a modified fourth state P40, T40, such that the working fluid, at an expander output has a lower pressure and enthalpy than the third state, such that P40<P3 and H40<H3.

The rotatable expander 130 may be characterized as operating close to isentropic, which causes not only a pressure loss but also a loss in enthalpy, such that in the fifth state modified fourth state P40, T40, the enthalpy H40 is less than that (H3) of the third state.

The system further comprises an evaporator 140, which may be configured to exchange heat with a heat supplying circuit 15, wherein heat is received by the evaporator 140, whereby the enthalpy of the working fluid is increased and the working fluid is vaporized, such that H40<H1.

The heat supplying circuit 15 may be a cooling circuit in a cooling device or an air conditioning device. Alternatively, the heat supplying circuit 15 may be configured to pick up heat from e.g. air, ground, bedrock or water in a heat pump system.

An evaporator input is connected to receive the working fluid in the modified fourth state from the rotatable expander 130. An evaporator output is connected to the input of the compressor 10.

Figure 3:
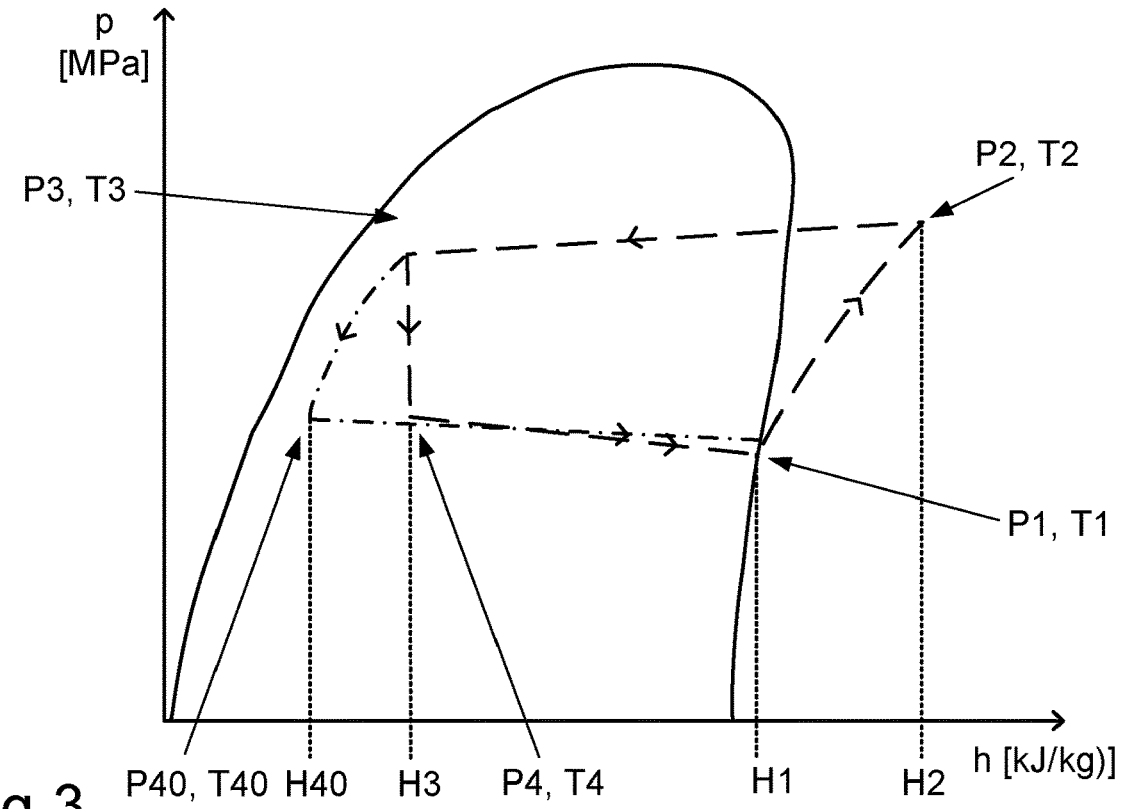
FIG. 3 is a schematic pressure-enthalpy diagram illustrating a comparison between the heat cycle systems in FIGS. 1 and 2.
Figure 4:
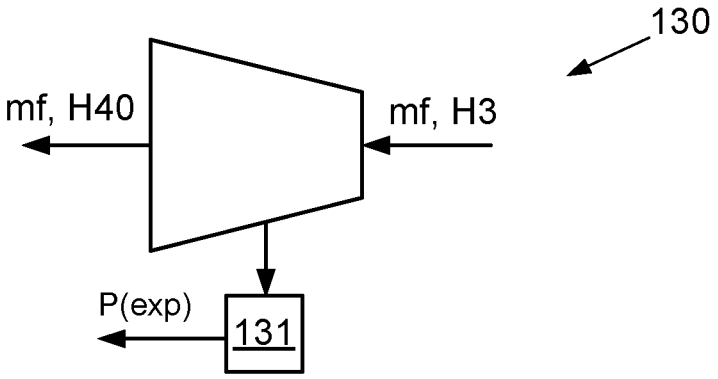
FIG. 4 is a schematic diagram of a rotatable expander 130 that can be used in the heat cycle system of FIG. 2.

FIG. 3 is a schematic pressure-enthalpy diagram, which illustrates the heat cycles in FIGS. 1 and 2.

In FIG. 3, the working fluid states P1, T1, H1, P2, T2, H2 and P3, T3, H3 have been indicated as identical in the conventional cycle according to FIG. 1 and the modified cycle according to FIG. 2. Hence, comparing the prior art system of FIG. 1 and the system according to the inventive concept of FIG. 2, the compressor 10 and the condenser 11 are identical, as is the selection of working fluid, the mass flow mf and the heat exchange conditions at the condenser and the compressor may be identical or designed for a higher inlet pressure. The described modifications allow use of a higher inlet pressure to the compressor for the same conditions in the condenser.

In FIG. 3, there is also indicated the enthalpy at the respective working fluid state. Hence, in the first state P1, T1, the enthalpy is H1; in the second state P2, T2, the enthalpy is H2 and in the third state, the enthalpy is H3.

In the system of FIG. 1, which uses an expansion valve 13, the expansion of the working fluid from the third state P3, T3 to the fourth state will be isenthalpic. Hence, the enthalpy of the fourth state P4, T4 is H3, i.e. the same as for the third state P3, T3.

However, in the system of FIG. 2, the rotatable expander 130 operates closer to isentropica, which causes not only a pressure loss but also a loss in enthalpy, such that in the modified fourth state P40, T40, H40, the enthalpy H40 is less than that (H3) of the third state.

The rotatable expander 130 may operate entirely below a saturation curve of the working fluid, such that the working fluid is in a two-phase state throughout the expansion. Alternatively, the rotatable expander may operate on the saturation curve or outside of the saturation curve.

In the evaporator 14, used in the system shown in FIG. 1, the working fluid will be evaporated and possibly superheated by adding enthalpy corresponding to the difference between the enthalpy in the first and third states, i.e. the enthalpy H1–H3 is added in the evaporator 14.

The evaporator 140 will need to add more enthalpy to the working fluid in the system of FIG. 2 as compared with the system of FIG. 1.

Hence, the evaporator 140 will have to evaporate the working fluid by adding enthalpy corresponding to the difference between the enthalpy in the first state and the modified fourth state, i.e. the enthalpy H1–H40 is added in the evaporator 140.

Therefore, the capacity of the evaporator 140 in FIG. 2 needs to be greater than the capacity of the evaporator 14 in FIG. 1.

Additionally, it may be advantageous to minimize pressure drop in the evaporator 140. Ideally, the heating of the working fluid in the evaporator 140 would take place under constant pressure, but in reality there will be some pressure losses, depending on the design of the evaporator, so that P4>P1. In particular the pressure drop in the evaporator 140 may be less than about 3 bar, preferably less than about 2 bar or less than about 1.5 bar.

The pressure drop reduction can be achieved by increasing the number of flow paths through the evaporator 140 and/or by increasing a flow area of the evaporator 140.

It may also be advantageous to shorten the connection between the rotatable expander 130 and the evaporator 140.

As illustrated in FIG. 3, the dash-dotted line from the point P40, H40 to the point P1, T1 indicates less pressure drop than the dash dotted line from P4, T4, H4 to P1, T1; H1.

Referring to FIG. 3, the rotatable expander 130 may be provided in the form of a scroll type expander or a GE rotor type expander.

However, other types of rotatable expanders may also be used.

The rotatable expander 130 is mechanically connected to a generator 131 for generating electric power.

The rotatable expander 130 receives a flow mf of the working fluid in the third state P3, T3 with an enthalpy H3 from the output of the condenser 12.

In the rotatable expander 130, the working fluid is isentropically expanded, with the working fluid being below the saturated liquid line, such that the working fluid is in two phase form.

The rotatable expander 130 outputs the working fluid at a lower pressure P40 and temperature T40, referred to as the modified fourth state, with also a lower enthalpy H40.

The rotation of the rotatable expander 130 drives the generator 131, which outputs electric power corresponding to P (exp), except for losses.

Figure 5:
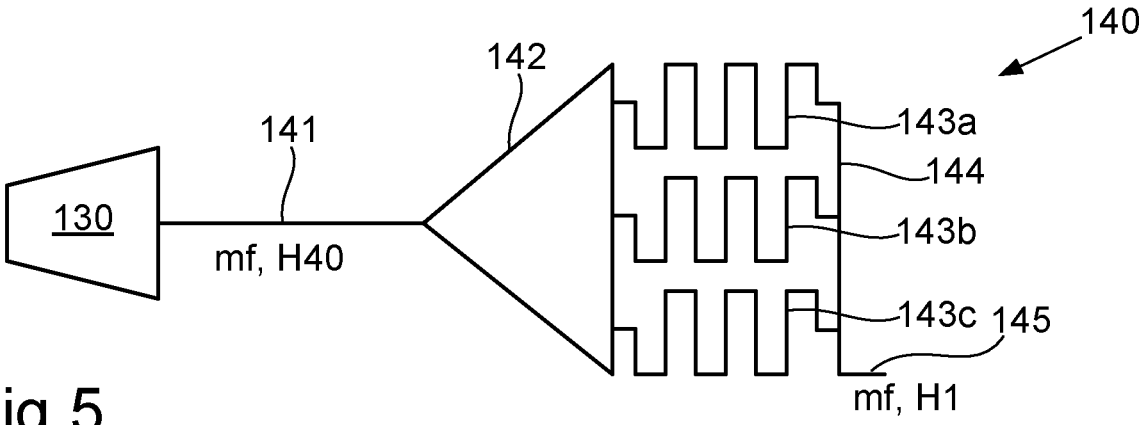
FIG. 5 is a schematic diagram of the evaporator 140.

Referring to FIG. 5, there is provided a schematic illustration of the evaporator 140.

The evaporator 140 is connected to the output of the rotatable expander 130, such that it receives the flow mf of the working fluid in the modified fourth state P40, T40, H40.

A connection 141 between the output of the rotatable expander 130 and the evaporator 140 may be made as short and straight as possible.

The connection 141 connects to a distributor 142, which divides the flow of working fluid into a plurality of evaporator channels 143*a*, 143*b*, 143*c*, each of which providing an evaporator subflow.

The subflows are merged by a collector 144 into an evaporator output 145, which connects to the compressor 10.

Each of the evaporator channels 143*a*, 143*b*, 143*c* may be formed as a respective flow path, such as a pipe, a tube or a hose, which may be connected to cooling flanges (not shown) for increasing heat exchange efficiency with a gaseous fluid.

Alternatively, the evaporator channels 143*a*, 143*b*, 143*c* may be formed by channels in a heat exchanger for heat exchange with a liquid.

The number of flow paths, and optionally the surface area of each flow path, can be selected to provide a desired pressure drop of less than 3 bar over the heat exchanger, with due consideration taken to the type of working fluid used in the relevant application.

From a power balance point of view, the system in FIG. 2 with a mass flow mf can be explained as follows:

$$\text{Power input:}\quad \begin{array}{ll} \text{Compressor}-P\,(comp): & mf\times(H2-H1) \\ \text{Evaporator}-P\,(evap): & mf\times(H1-H40) \end{array}$$

$$\text{Power output:}\quad \begin{array}{ll} \text{Condenser}-P\,(cond): & mf\times(H2-H3) \\ \text{Expander}-P\,(exp): & mf\times(H3-H40) \end{array}$$

Consequently, the evaporator will be dimensioned such that P(evap)=P(cond)+P(exp)–P(comp).

Experimental Data

In order to verify the principles of the system disclosed in FIG. 2, two commercially available heat pump systems in the form of Panasonic S-250PE3E5B were used as a starting point. These systems will be labelled "original system" and "modified system", respectively.

The "modified system" was modified as follows:

The expansion valve was replaced with a scroll type expander of the type DENSO SCSA06C 447220-6572 HFC134a. The scroll type expander was modified by removal of its non-return check valve and by increasing the flow area of the expander input to a diameter of about 14 mm.

The expander was connected to a brake, in the form of a Delta AC Servo Modell ECMA-J11330R4 KW 3,0/3000 rpm from Delta Electronics (Sweden) AB, which was used to emulate a generator connected to the outgoing axle of the rotatable expander 130.

The evaporator was replaced with an evaporator having higher capacity and lower pressure drop.

The evaporator was constructed by two open gable evaporator blocks of the type AIR0332 600×600-4R, available from Aircoil AB (SE). The evaporator blocks were connected in parallel and mounted with the blocks in a V formation with a 90 degree angle.

In total, the evaporator 140 comprises 16 channels having an internal diameter of 6.4 mm and an average length of about 1400 mm.

A 500 mm long pipe was used to connect the output of the rotatable expander 130 to the distributor of the evaporator.

The systems were further fitted with pressure and temperature sensors as follows.

The modified system was fitted with pressure sensors GP01, GP02 immediately upstream and downstream of the compressor 10; temperature sensors GT03 and GT01 immediately upstream and downstream of the compressor 10; pressure sensors GP03 and GP04 immediately upstream and downstream of the rotatable expander 130; temperature sensors GT02, GT504 immediately upstream and downstream of the rotatable expander 130, and a temperature sensor GT503 at the inlet of the rotatable expander, downstream of the temperature sensor GT02.

The modified system was also fitted with temperature sensors GT501 and GT502 in the air stream immediately upstream and downstream of the evaporator 140.

All pressure sensors were Carel 0-10 bar/0-10V/SPKT0011CO 45/20, available from Carel Industries S.p.A (IT).

All temperature sensors were of the type PT1000, which are available from Regin Controls Sverige AB (SE).

Pressure and temperature data was logged using EXOcompact Ardo, which is available from Regin Controls Sverige AB (SE).

The systems were installed in a climate chamber, at an ambient temperature of 33-34 degC and a relative humidity of 25-30%.

The systems were installed in parallel and in the same environment, such that their operating conditions would be identical.

The resulting data for the original system and for the modified system are disclosed in the table below.

The condenser was caused to exchange heat with ambient air in the climate chamber.

The evaporator of the modified system was caused to exchange heat with an air stream moving at 9550 m3/h in another climate chamber having a temperature of 25-35 degC and a relative humidity of 35-46%, driven by the fan provided in the original system.

The values of GP01-GP04 and GT01-GT03 for the original system are residual values from an installation run of the system. These values were not used for calculating the COPc for the original system.

During an operating cycle of 15 minutes for the original system, the following data was collected by the temperature sensors GT501, GT502, GT503 and GT504 (FIG. 1):

| No | GP01 | GP02 | GP03 | GP04 | GT01 | GT02 | GT03 | GT501 | GT502 | GT503 | GT504 |
|---|---|---|---|---|---|---|---|---|---|---|---|
| 1 | 14.31 | 14.33 | 10.11 | 10.10 | 22.31 | 22.38 | 22.27 | 23.56 | 9.33 | 23.48 | 23.27 |
| 2 | 14.32 | 14.34 | 10.11 | 10.10 | 22.33 | 22.41 | 22.36 | 23.65 | 9.26 | 23.48 | 23.29 |
| 3 | 14.33 | 14.35 | 10.12 | 10.11 | 22.37 | 22.48 | 22.33 | 23.54 | 9.26 | 23.48 | 23.38 |
| 4 | 14.34 | 14.36 | 10.11 | 10.10 | 22.35 | 22.49 | 22.32 | 23.73 | 9.26 | 23.48 | 23.39 |
| 5 | 14.35 | 14.37 | 10.11 | 10.10 | 22.40 | 22.51 | 22.42 | 23.78 | 9.22 | 23.51 | 23.44 |
| 6 | 14.36 | 14.38 | 10.12 | 10.11 | 22.43 | 22.55 | 22.42 | 23.64 | 9.30 | 23.55 | 23.48 |
| 7 | 14.37 | 14.39 | 10.12 | 10.11 | 22.46 | 22.54 | 22.46 | 23.89 | 9.24 | 23.59 | 23.60 |
| 8 | 14.37 | 14.39 | 10.12 | 10.10 | 22.45 | 22.61 | 22.50 | 24.04 | 9.27 | 23.59 | 23.68 |
| 9 | 14.38 | 14.39 | 10.12 | 10.11 | 22.50 | 22.68 | 22.53 | 24.24 | 9.34 | 23.66 | 23.70 |
| 10 | 14.39 | 14.40 | 10.12 | 10.12 | 22.55 | 22.67 | 22.54 | 24.54 | 9.27 | 23.70 | 23.80 |
| 11 | 14.39 | 14.41 | 10.12 | 10.12 | 22.54 | 22.68 | 22.59 | 24.38 | 9.35 | 23.71 | 23.87 |
| 12 | 14.40 | 14.42 | 10.13 | 10.12 | 22.59 | 22.71 | 22.58 | 24.01 | 9.34 | 23.81 | 23.92 |
| 13 | 14.41 | 14.42 | 10.13 | 10.12 | 22.60 | 22.75 | 22.61 | 23.75 | 9.26 | 23.81 | 23.94 |
| 14 | 14.42 | 14.43 | 10.13 | 10.13 | 22.66 | 22.76 | 22.66 | 24.12 | 9.59 | 23.86 | 24.00 |

Except for Pc, the following values were calculated for the original system:

| No | dPex | dP23 | dP41 | Qev[kW] | Pc | COP* |
|---|---|---|---|---|---|---|
| 1 | 0.02 | 4.22 | −4.22 | 24.39 | 9.21 | 2.65 |
| 2 | 0.01 | 4.23 | −4.22 | 24.65 | 9.21 | 2.68 |
| 3 | 0.01 | 4.23 | −4.23 | 24.46 | 9.21 | 2.66 |
| 4 | 0.01 | 4.24 | −4.24 | 24.79 | 9.21 | 2.69 |
| 5 | 0.01 | 4.26 | −4.25 | 24.94 | 9.21 | 2.71 |
| 6 | 0.01 | 4.26 | −4.25 | 24.57 | 9.21 | 2.67 |
| 7 | 0.01 | 4.27 | −4.26 | 25.11 | 9.21 | 2.73 |
| 8 | 0.01 | 4.27 | −4.26 | 25.29 | 9.21 | 2.75 |
| 9 | 0.01 | 4.27 | −4.27 | 25.53 | 9.21 | 2.77 |
| 10 | 0.01 | 4.28 | −4.27 | 26.16 | 9.21 | 2.84 |
| 11 | 0.01 | 4.29 | −4.28 | 25.76 | 9.21 | 2.80 |
| 12 | 0.00 | 4.29 | −4.27 | 25.15 | 9.21 | 2.73 |
| 13 | 0.01 | 4.28 | −4.29 | 24.83 | 9.21 | 2.70 |
| 14 | 0.00 | 4.29 | −4.29 | 24.91 | 9.21 | 2.70 |

The pressure differentials were calculated as follows: dPex=GP04−GP03; dP23=GP02−GP03; dP41=GP04−GP01.

Qev was calculated as 5040*0.34*(GT501−GT502), where the value 5040 from equipment supplier is the amount of air in m3/h per fan for the original system and the value 0.34 is a well known conversion factor from m3/h to kg/s for air at 285 K and 1 bar.

Pc is the standard power input value for the original system.

COP was calculated as Qev/Pc.

The average COP for the original system was thus 2.72.

During an operating cycle of 45 minutes for the modified system, the following data was collected by the pressure sensors GP01, GP02, GP03, GP04, and the temperature sensors GT01, GT02, GT03, GT04, GT501, GT502, GT503 and GT504:

| No | GP01 | GP02 | GP03 | GP04 | GT01 | GT02 | GT03 | GT501 | GT502 | GT503 | GT504 |
|---|---|---|---|---|---|---|---|---|---|---|---|
| 1 | 9.1 | 18.9 | 18.7 | 10.3 | 75.3 | 33.0 | 11.6 | 22.9 | 12.9 | 28.2 | 15.1 |
| 2 | 9.3 | 19.1 | 18.6 | 10.4 | 76.3 | 33.7 | 11.8 | 22.9 | 13.2 | 28.6 | 16.1 |
| 3 | 9.4 | 19.7 | 19.2 | 10.6 | 77.8 | 34.8 | 12.0 | 23.7 | 13.7 | 29.9 | 16.7 |
| 4 | 9.4 | 19.6 | 19.4 | 10.8 | 78.0 | 34.8 | 12.2 | 23.8 | 13.9 | 30.0 | 16.8 |
| 5 | 9.4 | 21.1 | 21.0 | 10.6 | 81.2 | 36.6 | 12.9 | 24.1 | 14.0 | 32.2 | 16.6 |
| 6 | 9.3 | 21.7 | 21.5 | 10.7 | 84.1 | 37.5 | 13.8 | 23.9 | 14.0 | 33.0 | 16.6 |
| 7 | 9.5 | 21.4 | 21.1 | 10.8 | 83.8 | 37.4 | 13.6 | 25.2 | 14.6 | 32.9 | 17.2 |

In the same manner as for the original system, values for pressure differences, Qev, Pc and COP were calculated based on the measured values for the modified system as follows:

| No | dPex | dP23 | dP41 | Bf | rpm | Pex[W] | Qev[kW] | Pc | COP* |
|---|---|---|---|---|---|---|---|---|---|
| 1 | 8.60 | 0.27 | 1.3 | 40 | 520 | 206.9 | 33.5 | 7.46 | 4.63 |
| 2 | 8.65 | 0.52 | 1.2 | 40 | 640 | 254.7 | 32.5 | 7.68 | 4.38 |
| 3 | 9.08 | 0.48 | 1.2 | 45 | 590 | 264.1 | 33.4 | 7.90 | 4.38 |
| 4 | 8.78 | 0.21 | 1.4 | 45 | 600 | 268.6 | 33.1 | 7.94 | 4.32 |
| 5 | 10.55 | 0.14 | 1.2 | 58 | 435 | 251.0 | 33.8 | 7.94 | 4.40 |
| 6 | 11.01 | 0.15 | 1.3 | 58 | 395 | 227.9 | 33.1 | 7.95 | 4.29 |
| 7 | 10.60 | 0.35 | 1.3 | 52 | 425 | 219.9 | 35.5 | 8.04 | 4.53 |

Measurement data of the torque ratio Bf and rpm were provided by the brake. Bf was measured as a percent of the brake's maximum torque.

Pex was calculated as $(2\times\pi\times n)/60\times Mn\times Bf$, where n is the rpm, Mn is the maximum torque and Bf is the torque ratio.

With an average value of Qev of 33.6 and an average value of Pc of 7.84, it is concluded that the average value of COP was 4.42.

As can be concluded from the table above, the COP of the modified heat pump system is improved as compared with the original system in terms, and the modified system is also able to generate an additional 0.2 KW of electric power, which corresponds to about 1700 kWh for 365 days of continuous operation. By comparison, an average electric power consumption of a normal single-family house in Sweden will be in the interval 5000-20000 kWh per year, depending on which heating method is used (the lower part of the interval would be for houses with district heating).

The results achieved with the modified system are deemed to be conservative, in that measured values of electric power have been as high as 0.3-0.35 KW, in a system where e.g. connecting pipes are longer than they would have been in a properly packaged and optimized system. It is estimated that at least 0.4-0.5 KW should be achievable.

Figure 6:
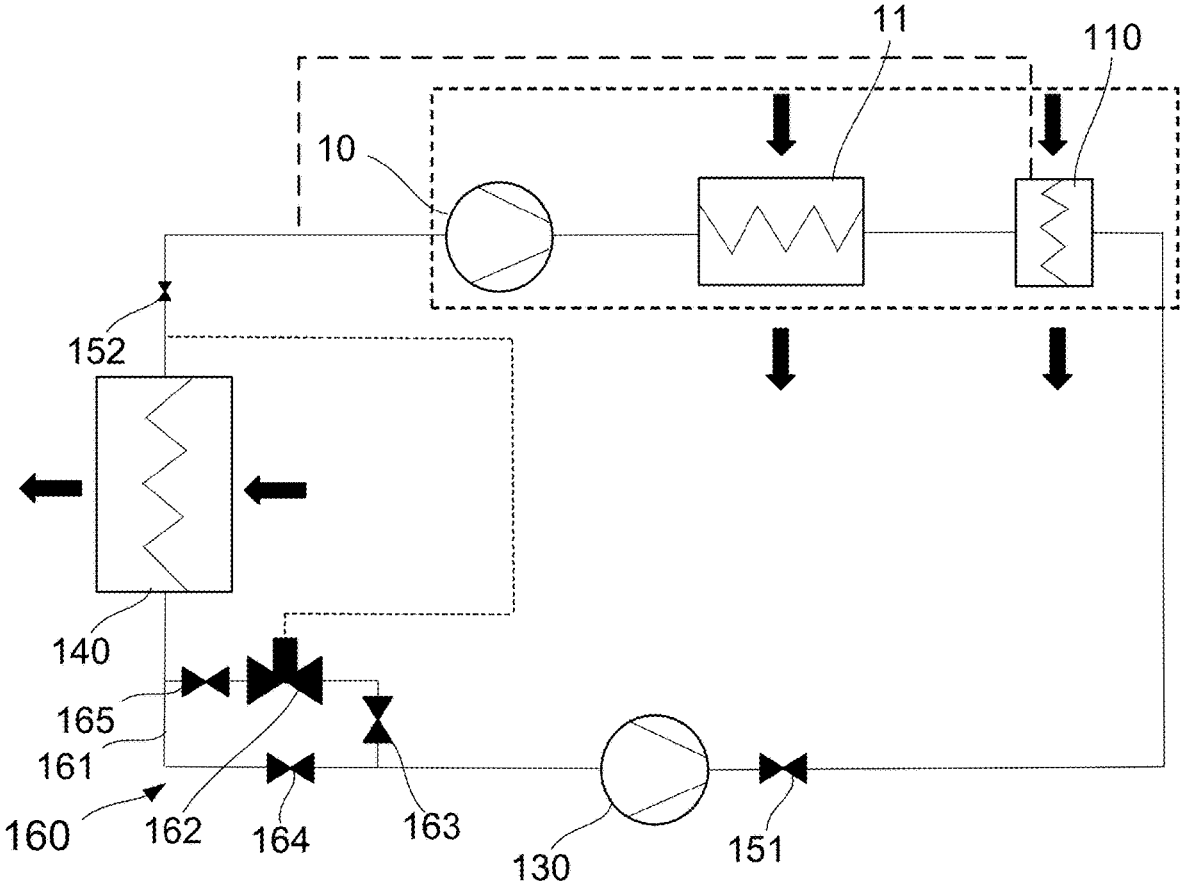
FIG. 6 is a schematic diagram of a modified version of the heat cycle system according to FIG. 2.

FIG. 6 schematically illustrates a further development of the heat cycle system illustrated with reference to FIG. 2. This further development aims at further increasing the efficiency of the heat cycle system.

In the following, only differences relative to the heat cycle in FIG. 2 will be described.

The heat cycle system illustrated in FIG. 6 comprises a subcooler 110, which is connected in series with, and downstream, of the condenser 11, such that the working fluid exiting the condenser 11 is introduced into the subcooler 110.

The provision of a subcooler 110 may increase the amount of liquid working fluid available at the inlet of the expander unit 130, which may in turn reduce leakage in the expander and thus increase expander efficiency.

The subcooler 110 may be caused to exchange heat with the working medium at a point upstream of the compressor 10, such as immediately upstream of the compressor, such that heat is effectively transferred from the working medium downstream of the condenser 11 to the working medium upstream of the compressor 10.

Tests were made with a modified version of the system described above. In particular, a heat exchanger in the form of an Aircoil 600×200 3R Air 0331 was connected downstream of the condenser by means of a ⅜ in connector.

A second modification can be made in the portion between the expander unit 130 and the evaporator 140, in that an expansion valve 162 may be connected in series with the expander unit 130 upstream of the evaporator 140. The expansion valve 162 may be operable in response to a condition downstream of the evaporator 140, in particular immediately downstream of the evaporator 140.

The expansion valve 162 may form part of an expansion arrangement 160, which may comprise a bypass connection 161 that makes the outlet of the expander unit 130 directly connectable to the evaporator 140, thus bypassing the expansion valve 162. One or more control valves 163, 164, 165 may be provided for shifting and/or adjusting the flow between the expansion valve 162 and the bypass channel 161. For example, the expansion arrangement 160 may be controlled based on measurements of pressure and/or temperature downstream of the evaporator 140. The control valves 163, 164, 165 may be adjustable between certain distributions, such as 50-50, 70-30, or the like.

The provision of the expansion arrangement 160 allows for fine tuning the amount of liquid working medium that is input to the evaporator 140, which, in turn, enhances the efficiency of the evaporator 140.

The system may further comprise one or more service valves 151, 152, which may be binary valves or valves that can be adjustable continuously or stepwise.

The arrangement of a subcooler and the expansion arrangement 160 has proven effective in increasing the COP of the system from about 2.8 to about 3.8, which is significant.

In order to verify the function of the modifications described with reference to FIG. 6, hereinafter referred to as "second modified system", additional tests were made. In particular, the original system described with reference to FIG. 1 as well as the modified system (hereinafter referred to as "first modified system") described with reference to FIG. 2 were used as comparisons.

In the additional tests, the expansion valve 162 was embodied by a Carel EV235 from CAREL INDUSTRIES S.p.A., Padova, Italy. The subcooler 110 was embodied as an Aircoil 600×200 3R, Air 0331 with a ⅜ inch connection from Aircoil AB, Årjäng, Sweden.

The additional tests were performed with the original and first modified system as the tests described above, but with a lower air flow over the evaporator.

| System | Qev(kW) | Pc (kW) | COP* |
|---|---|---|---|
| Original | 22.5 | 8.00 | 2.81 |
| Original | 21.3 | 8.02 | 2.66 |
| Original | 22.9 | 8.30 | 2.76 |
| First modified | 22.7 | 8.43 | 2.84 |
| First modified | 22.0 | 7.79 | 2.98 |
| First modified | 18.1 | 7.66 | 2.47 |
| Second modified | 27.9 | 7.65 | 3.86 |
| Second modified | 24.7 | 7.65 | 3.43 |
| Second modified | 28.0 | 7.76 | 3.82 |
| Second modified | 28.8 | 7.88 | 3.83 |
| Second modified | 29.5 | 7.70 | 3.98 |

From the tests, it was noted that for the original system, the average COP* was 2.74 and for the first modified system, the average COP* was 2.77. However, for the second modified system, the average COP* was 3.78. It is concluded that the second modified system provides for a substantial improvement in efficiency.

10

The invention claimed is:

1. A method of operating a heat cycle system, wherein the heat cycle system comprises a working fluid, which is cycled through a circuit comprising a compressor (10), a condenser (11), an expander unit (130), and an evaporator (140), wherein the expander unit (130) is configured to generate a rotating mechanical motion, wherein the method comprises:

operating the compressor (10) to receive the working fluid in a first state, with a first pressure (P1), a first temperature (T1) and a first enthalpy (H1), and to compress the working fluid to a second state with a second pressure (P2), a second temperature (T2) and a second enthalpy (H2), operating the condenser (11) to receive the working fluid in the second state, and to condense the working fluid to a third state with a third pressure (P3), a third temperature (T3) and a third enthalpy (H3), operating the expander unit (130) to receive the working fluid in the third state, and to expand the working fluid to a modified fourth state with a modified fourth pressure (P40), a modified fourth temperature (T40) and a modified fourth enthalpy (H40), operating the evaporator (140) to receive the working fluid in the modified fourth state, and to evaporate the working fluid to the first state, wherein a nominal evaporator working fluid evaporation capacity is defined as an amount of an enthalpy reduction (H2–H3) provided by the condenser less an amount of an enthalpy increase (H2–H1) provided by the compressor, characterized by operating the evaporator at an evaporator working fluid evaporation capacity that is at least 110% of the nominal evaporator working fluid evaporation capacity, and a pressure drop of the working fluid over the evaporator is less than about 5 bar, and wherein power provided to the working fluid by the evaporator is greater than a power required to essentially isobarically raise an entropy of the working fluid from an entropy level at an outlet of the condenser to an entropy level corresponding to saturation.

2. The method as claimed in claim 1, wherein an a power of the evaporator transferred to the working fluid corresponds to a sum of a heat power removed from the working fluid by the condenser and a power generated by the working fluid at the rotatable expander less a power provided to the working fluid by the compressor.

3. The method as claimed in claim 1, wherein the pressure drop of the working fluid over the evaporator is 0.50-0.75 bar; 0.75-1.00 bar; 1.00-1.25 bar; 1.25-1.50 bar; 1.50-1.75 bar; 1.75-2.00 bar; 2.00-2.25 bar; 2.25-2.50 bar; 2.50-2.75 bar; 2.75-3.00 bar; 3.00-3.25 bar; 3.25-3.50 bar; 3.50-3.75 bar; 3.75-4.00 bar; 4.00-4.25 bar; 4.25-4.50 bar; 4.50-4.75 bar; or 4.75-5.00 bar.

4. The method as claimed in claim 1, wherein the expander unit (130) is selected from a group consisting of a rotation type expander, a swing type expander, a scroll type expander, a GE rotor type expander, a reciprocating type expander, a screw type expander and a radial turbo type expander.

5. The method as claimed in claim 1, wherein a generator (131) is mechanically connected to the expander unit (130) for generating electricity, and wherein the generator (131) is operated to generate electric power as the expander unit (130) is caused to rotate during the expansion of the working fluid.

6. The method as claimed in claim 1, further comprising subcooling the working fluid downstream of the condenser (11) and upstream of the expander unit (130).

7. The method as claimed in claim 6, wherein the working fluid downstream of the condenser (11) and upstream of the expander unit (130) is caused to exchange heat with the working fluid upstream of the compressor (10) and downstream of the evaporator (140).

8. The method as claimed in claim 1, further comprising causing at least some of the working fluid downstream of the expander unit (130) and upstream of the evaporator (140) to undergo further expansion in an expansion valve (162).

9. The method as claimed in claim 8, wherein the working fluid exiting from the expander unit (130) is selectively distributed between the expansion valve (162) and a bypass connection (161), which bypasses the expansion valve (162).

10. The method as claimed in claim 8, wherein the expansion valve (162) is operable based on a condition downstream of the evaporator (140).

11. The method as claimed in claim 1, wherein the condenser (11) is caused to exchange heat with a first external working fluid in a form of a gas.

12. The method as claimed in claim 1, wherein the evaporator (140) is caused to exchange heat with a second external working fluid in a form of a gas.

13. A heat cycle system, comprising:

a working fluid, which is cycled through a circuit comprising a compressor (10), a condenser (11), an expander unit, and an evaporator (140), wherein the expander unit is configured to generate a rotating mechanical motion, wherein a nominal evaporator working fluid evaporation capacity is defined as an amount of an enthalpy reduction (H2-H3) provided by the condenser less an amount of an enthalpy increase (H2-H1) provided by the compressor, characterized by the evaporator is sized and adapted to provide an evaporator working fluid evaporation capacity that is at least 110% of the nominal evaporator working fluid evaporation capacity, and a pressure drop of the working fluid over the evaporator is less than 5 bar, and wherein the evaporator is configured such that power provided to the working fluid by the evaporator is greater than a power required to essentially isobarically raise an entropy of the working fluid from an entropy level at an outlet of the condenser to an entropy level corresponding to saturation.

14. A method of modifying a heat cycle system, wherein the heat cycle system comprises:

a working fluid, which is cycled through a circuit comprising a compressor (10), a condenser (11), an expansion valve (13), and a first evaporator (14), wherein the method comprises:

replacing the expansion valve (13) with an expander unit that is configured to generate a rotating mechanical motion, and replacing the first evaporator (14) with a second evaporator (140) having greater working fluid evaporation capacity than the first evaporator (14), and wherein the second evaporator is configured such that power provided to the working fluid by the second evaporator is greater than a power required to essentially isobarically raise an entropy of the working fluid from an entropy level at an outlet of the condenser to an entropy level corresponding to saturation.

* * * * *